United States Patent [19]

Ohm

[11] 3,953,858

[45] Apr. 27, 1976

[54] MULTIPLE BEAM MICROWAVE APPARATUS

[75] Inventor: Edward Allen Ohm, Holmdel, N.J.

[73] Assignee: Bell Telephone Laboratories, Incorporated, Murray Hill, N.J.

[22] Filed: May 30, 1975

[21] Appl. No.: 582,103

[52] U.S. Cl. ..... 343/779; 343/756; 343/781; 343/837

[51] Int. Cl.[2] ..... H01Q 19/14

[58] Field of Search ..... 343/756, 779, 781, 837, 343/838

[56] References Cited

UNITED STATES PATENTS

| | | | |
|---|---|---|---|
| 2,983,918 | 5/1961 | Parmeggiani | 343/756 |
| 3,195,137 | 7/1965 | Jakes, Jr. | 343/756 |
| 3,492,484 | 1/1970 | Iti | 250/199 |
| 3,562,753 | 2/1971 | Tanaka et al. | 343/781 X |
| 3,680,141 | 7/1972 | Karikomi | 343/781 X |
| 3,792,480 | 2/1974 | Graham | 343/837 X |
| 3,797,020 | 3/1974 | Roger et al. | 343/779 X |
| 3,810,185 | 5/1974 | Wilkinson | 343/756 |

*Primary Examiner*—Alfred E. Smith
*Assistant Examiner*—E. R. LaRoche
*Attorney, Agent, or Firm*—Daniel D. Dubosky

[57] ABSTRACT

A compact offset Cassegrainian antenna having a paraboloidal main reflector and a convex subreflector brings microwave beams to a focus. A small flat reflector placed in one of the beams at the focus deflects it for interception by a concave reflector and horn. Another beam passing by the flat reflector is intercepted by a second concave reflector and horn. The flat reflector is smaller than a focally located horn, allowing more closely-spaced beams to be accommodated. The flat reflector may be replaced by a curved reflector, a prism, or a microwave lens. Another flat reflector is added for each additional beam. Polarized beams are accommodated by adding a polarization screen.

13 Claims, 6 Drawing Figures

MULTIPLE BEAM MICROWAVE APPARATUS

BACKGROUND OF THE INVENTION

The present invention relates to microwave apparatus. More specifically, the present invention relates to apparatus for the transmission and reception of more than one microwave beam at a time. An example of such apparatus is a single antenna which can transmit and receive two or more microwave beams in different directions.

The cost and practical convenience of multiple beam apparatus are important determinants of its utility. Accordingly, the utility can be enhanced by application of inventive concepts which reduce cost by providing a more compact structure composed of smaller parts and which provide practical convenience by allowing for many convenient locations for the parts.

The radiation gathered by a multiple beam antenna in its receive mode must be efficiently conducted through the structure. Undesirable dispersal, blockage, or loss of the radiation necessitates a larger structure and more widely spaced beams as compared with an antenna not exhibiting such undesirable characteristics. Likewise, transmitted beams must not be allowed to spill over or disperse in unintended directions.

A multiple beam antenna having low blockage and spillover effects is disclosed in my U.S. Pat. No. 3,914,768 "Multiple-Beam Cassegrainian Antenna," issued Oct. 21, 1975, and assigned to the assignee hereof. Feed horns transmit beams which are centered on a paraboloidal main reflector after reflection by a hyperboloidal subreflector enlarged and located to eliminate spillover and blockage. The centering of beams permits a smaller main reflector than is required in an antenna having the beams set with centers apart.

The feed horns can efficiently receive beam energy from the entire main reflector surface due to the centering of the radiation pattern of each horn on the main reflector. The beams of received radiation are focused into their respective horns. The focus must be properly located to achieve compactness and convenience in mounting, adjustment, and location of the feed system.

The minimum size of the main reflector has heretofore been limited by the physical size of the feed horns into which the beams are focused. Each feed horn has an aperture for receiving one of the beams. The beams are unrecoverable separately when the horn apertures required for good coupling are too large because the beams cannot then be centered in the horns with the horns side by side. It is necessary either to use a larger main reflector to feed the beams to the horns, or to use larger beam spacing angles. Either way, the horns must be located near one another in an arrangement which can prove to be inconvenient in practice.

Accordingly, an object of the present invention is to eliminate feed horn size as a constraining factor in multiple beam antenna design.

Another object of the present invention is to increase design freedom in the location of feed horns in a multiple beam antenna.

Another object of the present invention is to minimize the size of the main reflector in a multiple beam antenna having a given beam spacing.

Another object of the present invention is to reduce the minimum spacing of multiple beams which may be received and transmitted by a multiple beam antenna having a given main reflector size.

SUMMARY OF THE INVENTION

In accordance with the present invention, an essentially paraboloidal main reflector having an aperture receives multiple beams centered upon it. The main reflector is oriented so that without additional apparatus, the beams would be reflected and would part at a point outside the aperture. However, a convex subreflector is placed outside the aperture near the main reflector where the beams still overlap so that the beams are somewhat folded by reflection, thereby reducing the required size of the whole antenna structure. The subreflector is large enough so that essentially all of the beam energy is reflected by it to a focus.

Instead of placing feed horns at the focus, a small deflector, such as a flat reflector, curved reflector, prism or lens, is placed at or near the focus in one of the beams. The deflector can be significantly smaller than a horn, so that beams more closely spaced than horns can accommodate, can be deflected apart. The result is that the main reflector may be significantly reduced in size by comparison with a similar antenna using focally-located horns; or the same main reflector can be used for higher resolution. Aberrations in the system may be inexpensively reduced by adjusting the surface of the small deflector.

Feed horn means, no longer confined to the focal region, receive the beams. If the deflector is a curved concave reflector or converging microwave lens, a feed horn by itself may be used for reception. If a beam is insufficiently convergent, a converging reflector or lens may be added to introduce the beam into its respective feed horn. In either case, location of the feed horn means is flexible and feed horn size is eliminated as a constraining factor in the design.

Due to reciprocity, the invention may be used for transmission, reception, or both at the same time. Hence, every description of the structure, operation and advantages of the invention for reception corresponds to a reciprocal description relating to transmission, and vice versa.

BRIEF DESCRIPTION OF THE DRAWINGS

The present invention will be more fully understood from the following detailed description taken by reference to the appended drawings, in which.

DETAILED DESCRIPTION

Figure 1:
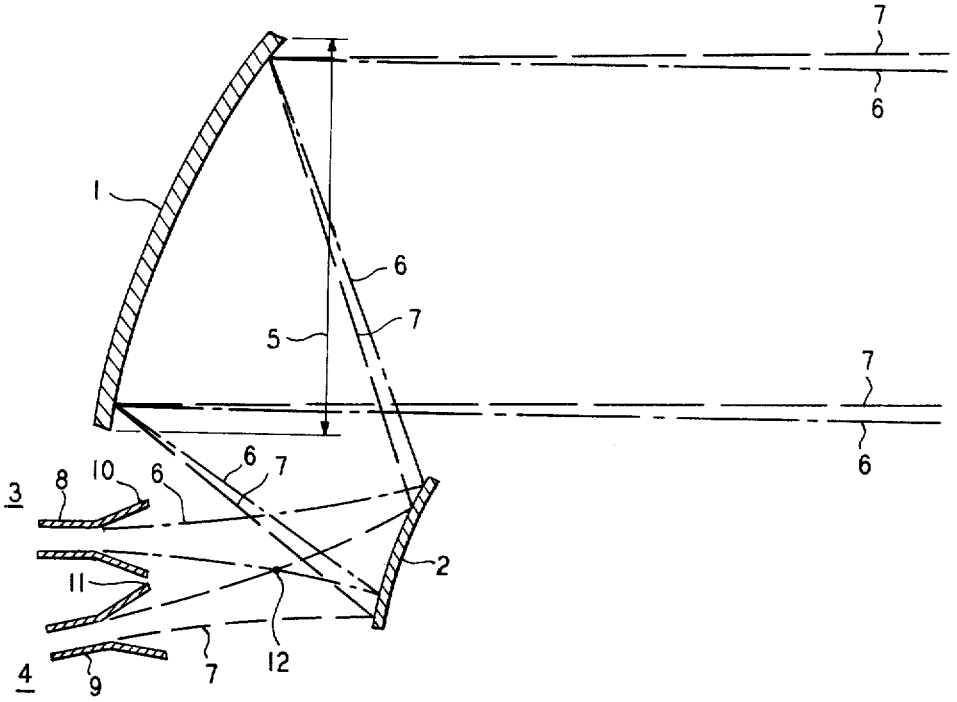
FIG. 1 is a longitudinal cross-section of a multiple beam microwave antenna according to my above-identified U.S. Pat. No. 3,914,768.

In FIG. 1, a main reflector 1 receives a pair of microwave beams through antenna aperature 5. The beams have respective contours 6 and 7 which are conceptual envelopes each containing most of the energy of a beam. The beams are reflected by main reflector 1 so that overlapping contours 6 and 7 converge toward subreflector 2 from which the beams are reflected toward feed horns 3 and 4. Contours 6 and 7 decreasingly over-lap from subreflector 2 and part at point 12; and since the contours contain most of the beam energy, it is conventional to say that the beams decreasingly overlap and part as well.

Horns 3 and 4 receive the beams in narrow throats 8 and 9 through flared apertures 10 and 11, respectively. Flared apertures 10 and 11 of the horns limit the closest spacing of contours 6 and 7 that can be accommodated when horns 3 and 4 are side-by-side as shown in FIG. 1. Thus, the aperture size of horns 3 and 4 places a physical limitation on the minimum angular spacing of two beams incident upon main reflector 1 for a given size of the main reflector and wavelength. Also, the horns must be larger if the main reflector is smaller, so there is a minimum main reflector size for a given angular beam spacing and wavelength.

Figure 2:
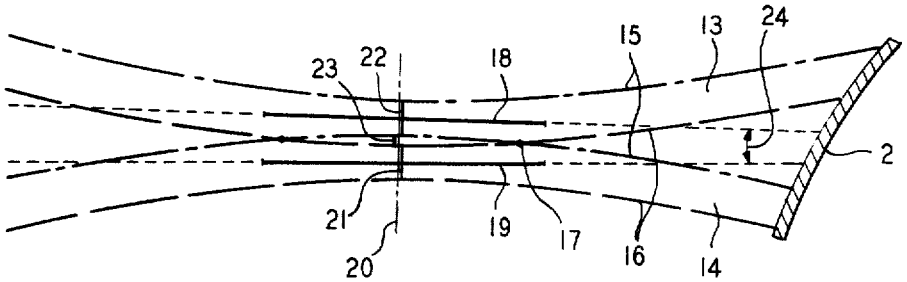
FIG. 2 is a longitudinal cross-section of a region including the subreflector of a microwave antenna showing an analysis of a pair of closely-spaced beams.

FIG. 2 shows an analysis of two beams more closely spaced than are separable by the antenna system of FIG. 1. As shown in FIG. 2, beams 13 and 14 are reflected from subreflector 2. Each beam has a beam axis shown as a dotted line. There is a small angle 24 between the beam axes. The beams have contours 15 and 16 which decreasingly overlap from subreflector 2 until they part at point 17; and the beams themselves decreasingly overlap and part in the region of the focal plane 20 as well.

Each of the beams converges toward a region of maximum energy concentration called the beam waist which has a contour diameter called the beam waist diameter. Beam 13 has beam waist diameter 22, and beam 14 has beam waist diameter 21. Focal plane 20 passes through each beam somewhat to the left of the beam waists. Each beam narrows to its waist upon reflection from subreflector 2 and then diverges. Owing to the slight angular displacement 24, the maximum separation distance 23 between contour 15 and contour 16 is slightly to the left of the beam waists away from the subreflector.

Figure 3:
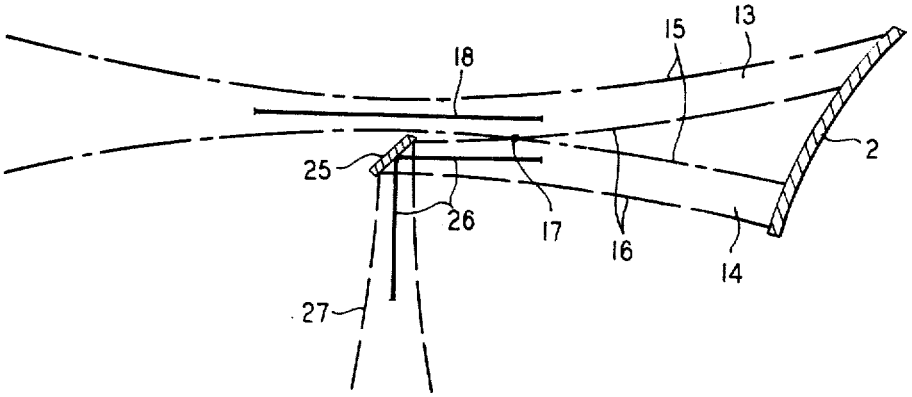
FIG. 3 is a longitudinal cross-section of a region including the subreflector of a microwave antenna showing an analysis of a beam separation technique utilized in the present invention.

The confocal parameter length of a beam is defined to be a segment of the beam axis in the part of the beam including the beam waist which is bounded at points where the beam contour diameter is $\sqrt{2}$ times as large as the beam waist diameter. Beam 13 has confocal parameter length 18 and beam 14 has confocal parameter length 19. FIG. 3 illustrates a technique for separating the closely spaced beams of FIG. 2. In FIG. 3, beams 13 and 14 are reflected from subreflector 2. Beam 13 has a contour 15, and beam 14 has a contour 16. The beams decreasingly overlap until they part at point 17. Beam 13 has confocal parameter length 18, and beam 14 has confocal parameter length 26. The beams are so closely spaced that point 17 lies between the confocal parameter lengths of the beams.

An essentially flat beam deflector mirror 25 is placed within the confocal parameter length 26 of beam 14. Mirror 25 can be advantageously located at a beam waist where the beams are maximally separated so that essentially all of the energy of beam 14 is deflected away with contour 27 and essentially no energy of beam 13 is so deflected. A curved reflector, a transmissive deflector such as a microwave lens or prism, or any other structure which deflects or otherwise brings one beam away from the other may alternatively be interposed in one of the beams where the two beams have become parted.

Figure 4:
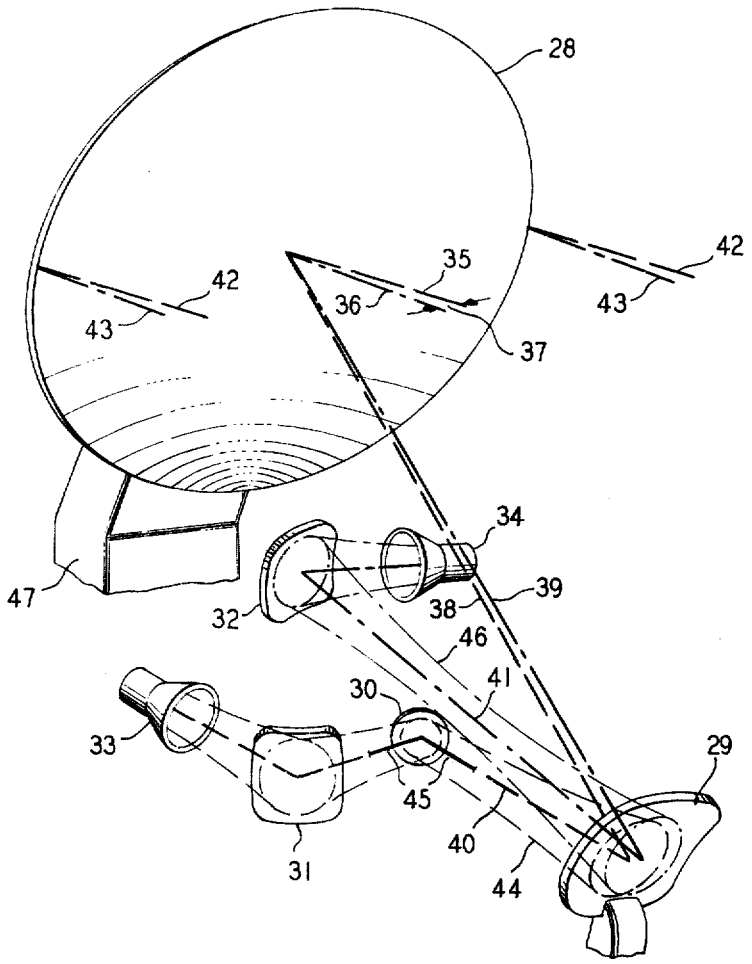
FIG. 4 is a perspective view of an antenna embodying the present invention.

FIG. 4 is a perspective view of an embodiment of the present invention. FIG. 4 shows an offset Cassegrainian multiple beam antenna having a paraboloidal concave main reflector 28, a hyperboloidal convex subreflector 29, a small reflector 30 and a feed system consisting of horn 34 with ellipsoidal reflector 32 and horn 33 with ellipsoidal reflector 31. The main reflector and subreflector surfaces may be shaped to deviate from a true paraboloid and hyperboloid, respectively, to improve performance. The horns can be corrugated horns of a type familiar to the art. Or, for increased bandwidth, the corrugated horns can have a cylindrical, rather than conical shape.

An ellipsoidal reflector is called an ellipsoid for brevity below, but it is to be understood that other concave shapes can be suitable. An antenna support structure 47 is suggested in the drawing. This antenna can accommodate multiple beams, each beam carrying distinct communication channels on many frequencies and on each of two polarizations.

Incident beams and contours 42 and 43 respectively having nonparallel beam axes 35 and 36 separated by angle 37 are centered upon main reflector 28. The beams then pass with axes 38 and 39 respectively outside of the antenna aperture to subreflector 29 from which they are redirected with axes 40 and 41 respectively to a focus also outside of the aperture. Reflectors 28 and 29 act as a reflector system for separating the beams in the focal plane in the manner illustrated in FIG. 2. Contours 44 and 46 decreasingly overlap behind the subreflector 29 and come apart.

In the region where the contours are parted, a subreflector 30 brings one of the beams away from the other in the manner taught in connection with FIG. 3. The essentially flat reflector or mirror 30 is placed on confocal parameter length 45 of the beam having contour 44. A feed system including the horn-ellipsoid pairs 34, 32, 33 and 31, receives the separated beams. Each ellipsoid converges a microwave beam to a horn. A converging lens may be used instead of an ellipsoid. More than two beams can be accommodated with more mirrors and with more feed horn means such as the horn-ellipsoid pairs.

Mirror 30 may also be used to help correct abberations in the focusing system 28, 29 of the multiple beam microwave antenna. Since mirror 30 is small, its surface can be easily modified to help correct aberrations. For example, an aberration having a cylindrical character due to reflectors 28 and 29 occurs in the offset Cassegrainian multiple beam antenna of FIG. 4. The cylindrical aberration may be partially remedied by a cylindrical correction applied to the surface of mirror 30. Similarly, the surface of a curved reflector or a lens or prism used in place of mirror 30 may be adjusted by modifying the surface so that a cylindrical curve of appropriate axial orientation and radius of curvature is added to the original surface shape.

Figure 5:
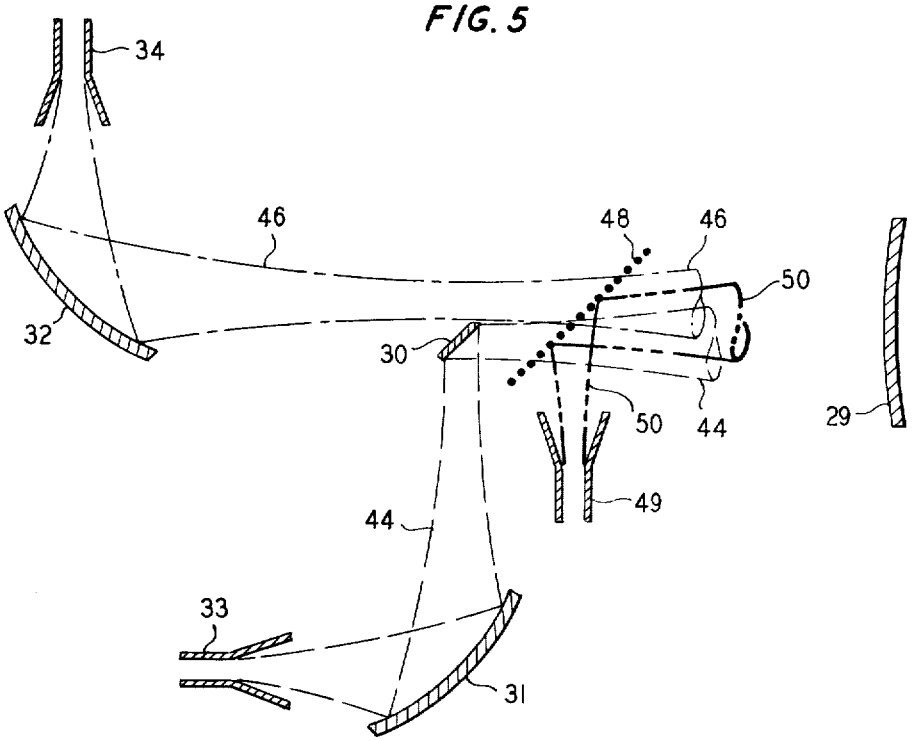
FIG. 5 is a horizontal cross-section of the feed system and subreflector of an antenna embodying the present invention in which single-polarized beams having orthogonal linear polarizations are employed.

FIG. 5 shows another embodiment of the invention which incorporates a technique called beam interleaving. A polarization screen 48 is inserted in the system of FIG. 4 shown in horizontal cross-section. For convenience, each beam or beam polarization component is designated by the number of its corresponding contour hereafter. Feed horn 49 transmits a single-polarized beam 50 to polarization screen 48 which reflects beam 50 between beams 44 and 46 toward subreflector 29 and on to the main reflector not shown. Beams 44 and 46 are restricted to the polarization complementary to beam 50 so that they pass through screen 48 essentially unaffected. It should be understood that beam 50 can be arbitrarily located with respect to beams 44 and 46 and that beam 50 can be one of several beams reflected from screen 48. Feed horn 49 can operate reciprocally to intercept beam 50 in the receive mode. Mirror 30 and horn-ellipsoid pairs 34, 32 and 33, 31 operate as previously described in connection with FIG. 4.

Figure 6:
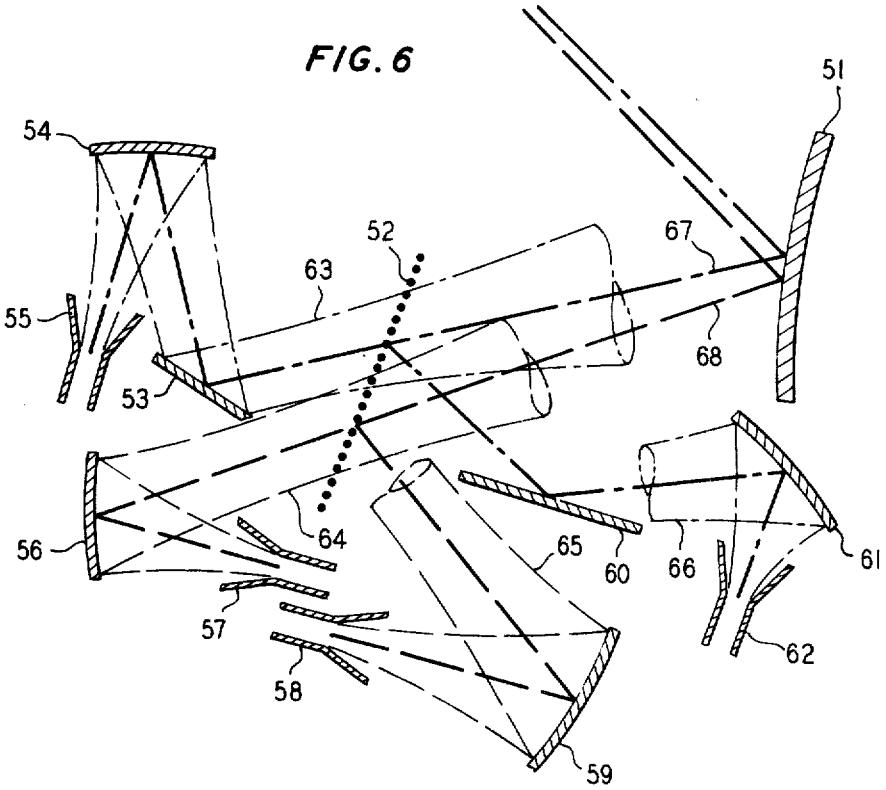
FIG. 6 is a longitudinal cross-section of the feed system and subreflector of an antenna embodying the present invention and employing dual polarized beams.

FIG. 6 shows an embodiment of the present invention for separating all of the polarization components in a dual polarized multiple beam system, i.e., a system carrying distinct communications channels on each polarization.

Subreflector 51 and a main reflector (not shown) operate like the subreflector and main reflector of FIG. 4 in focusing received beams. Polarization screen 52 separates the beam having axis 67 into polarization components 63 and 66 and the beam having axis 68 into components 64 and 65. Mirrors 53 and 60 deflect component 63 from 64 and component 66 from 65, respectively, in the manner taught in connection with FIG. 3. Each component is intercepted by an ellipsoid-and-horn pair — component 63 by ellipsoid 54 and horn 55; component 64 by ellipsoid 56 and horn 57; component 65 by ellipsoid 59 and horn 58; and component 66 by ellipsoid 61 and horn 62.

FIGS. 4, 5 and 6 are illustrative of many variations in design which may be used in practicing the invention. Many arrangements including one or more deflectors and polarization screens are possible, and more than two beams can be accommodated by applying the teachings of this invention. Polarization screen 52 is illustrative of many structures which may be used to separate a beam into components having distinct polarizations and frequencies. Each deflector and polarization screen may be adjusted in shape and extent to suit the needs of an intended design. If only one component e.g., a polarization component, need be reflected by a mirror, the mirror can be replaced by a partially reflecting surface reflective to the component, such as a polarization screen, without departing from the spirit and scope of the invention.

The invention lends itself to a multitude of variations in structure, shape and orientation of parts so that the utility of the invention as a whole may be fully realized. Hence, it is to be understood that the disclosure of particular embodiments hereinabove merely suggests the much more extensive range of apparatus comprehended in the invention.

Accordingly, what is claimed is:

1. A multiple beam microwave antenna comprising an essentially paraboloidal main reflector having an aperture;

a convex subreflector located outside said aperture so that a first and second microwave beam centered upon said main reflector overlap between said main reflector and said subreflector and are reflected to and are parted at a focus outside said aperture, said first and second beams respectively having a confocal parameter length;

first and second feed horn means; and a deflector placed in said first beam within its confocal parameter length so as to deflect said first beam to said first feed horn means; said second feed horn means being positioned so as to receive said second beam.

2. A multiple beam microwave antenna as claimed in claim 1 wherein said deflector is a prism.

3. A multiple beam microwave antenna as claimed in claim 1 wherein said deflector is a microwave lens.

4. A multiple beam microwave antenna as claimed in claim 1 wherein said first feed horn means comprises an ellipsoidal reflector and a feed horn.

5. A multiple beam microwave antenna as claimed in claim 1 wherein said deflector is an essentially flat reflector;

said first feed horn means comprises an ellipsoidal reflector and a feed horn; and said second feed horn means comprises an ellipsoidal reflector and a feed horn.

6. A multiple beam microwave antenna as claimed in claim 1 wherein said first feed horn means comprises a microwave lens and a feed horn.

7. A multiple beam microwave antenna as claimed in claim 1 wherein the apparatus further comprises means, placed in at least one of said first and second beams, for deflecting microwave radiation of but one polarization, and means for intercepting said radiation.

8. A multiple beam microwave antenna as claimed in claim 1 wherein said deflector is a reflector.

9. A multiple beam microwave antenna as claimed in claim 8 wherein said reflector is an essentially flat reflector and said first and second feed horn means each include means for converging a microwave beam.

10. A multiple beam microwave antenna as claimed in claim 8 wherein said reflector has a surface providing some aberration correction.

11. A multiple beam microwave antenna as claimed in claim 1 wherein said deflector is transmissive.

12. A multiple beam microwave antenna as claimed in claim 11 wherein said deflector has a surface providing an aberration correction.

13. Multiple beam microwave apparatus comprising means for focusing at least two microwave beams, including a first beam and a second beam, each having two polarization components, at least one polarization component of said first beam and at least one polarization component of said second beam decreasingly overlapping from said focusing means and becoming parted from each other;

means placed in said first and second beams for separating said polarization components in the same beam from each other;

deflecting means located where at least one polarization component of said first beam is parted by said focusing means from at least one polarization component of said second beam; and first, second, third and fourth intercepting means, said polarization separating means and said deflecting means being so placed that each of said polarization components is brought to a different one of said intercepting means.

* * * * *